United States Patent [19]

Skutecki et al.

[11] 4,017,726

[45] Apr. 12, 1977

[54] FOUR QUADRANT RATE TAKER AND SYNCHRONIZER

[75] Inventors: Edmund R. Skutecki; Carl D. Griffith, both of Phoenix, Ariz.

[73] Assignee: Sperry Rand Corporation, New York, N.Y.

[22] Filed: Nov. 5, 1975

[21] Appl. No.: 629,473

[52] U.S. Cl. ..... 235/186; 235/189; 340/347 SY

[51] Int. Cl.[2] ..... G06G 7/22

[58] Field of Search ..... 235/186, 189; 332/23; 329/50; 340/347 SY

[56] References Cited

UNITED STATES PATENTS

| | | | |
|---|---|---|---|
| 3,320,552 | 5/1967 | Glasser | 332/23 |
| 3,493,737 | 2/1970 | Edelson | 235/189 |
| 3,514,719 | 5/1970 | Rhodes | 332/23 |
| 3,676,659 | 7/1972 | Asmussen | 235/189 X |
| 3,705,980 | 12/1972 | Brickner et al. | 235/186 |

*Primary Examiner*—Joseph F. Ruggiero
*Attorney, Agent, or Firm*—Howard P. Terry; Seymour Levine

[57] ABSTRACT

An apparatus for extracting signals, proportional to data relative to a given variable, from two data modulated signals which mutually define the variable. Each signal is followed-up with a linear integrate/clamp circuit, the outputs of which are cross multiplied with the input signals. The multiplier output signals are summed and appropriately shaped to provide an output signal that is proportional to the desired angular rate.

4 Claims, 1 Drawing Figure

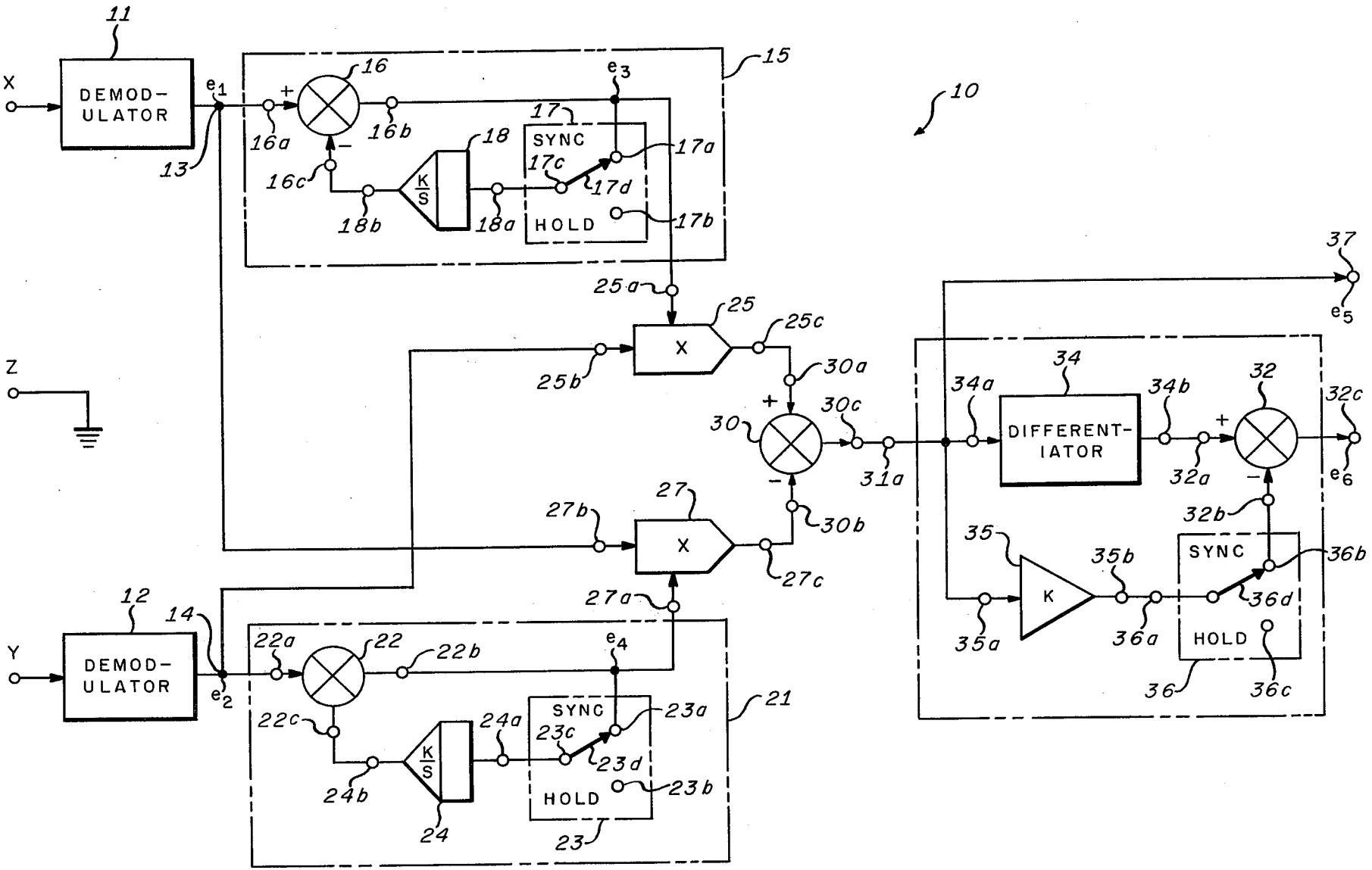
DEMOD-ULATOR
DEMOD-ULATOR
DIFFERENT-IATOR
SYNC
HOLD
SYNC
HOLD
SYNC
HOLD
K
K/S
K/S
X
X
X
10
11
12
13
14
15
16
16a
16b
16c
17
17a
17b
17c
17d
18
18a
18b
21
22
22a
22b
22c
23
23a
23b
23c
23d
24
24a
24b
25
25a
25b
25c
27
27a
27b
27c
30
30a
30b
30c
31a
32
32a
32b
32c
34
34a
34b
35
35a
35b
36
36a
36b
36c
36d
37
e1
e2
e3
e4
e5
e6
X
Y
Z

FOUR QUADRANT RATE TAKER AND SYNCHRONIZER

BACKGROUND OF THE INVENTION

1. Field of the Invention

The present invention relates generally to the field of electrical angle and angle rate measurements and more particularly to circuits for electrically deriving signals proportional to an angle error and an angle rate as represented by synchro or resolver signals.

2. Description of the Prior Art

Conventional systems for deriving angular rate and angular error signals from three-wire signal information have employed elecrtro-mechanical devices which convert the shaft speed or shaft position of a servomotor to electrical signals representative of the angular rate or error. Recently developed techniques for the derivation of angular error signals, to eliminate necessity for the utilization of electro-mechanical devices, involve complex analog phase shifting circuitry, complex digital techniques requiring analog-to-digital conversion circuitry such as that taught in U.S. Pat. No. 3,376,570 issued to A. D. Lawson and complex quadrant switching which requires special techniques for transient suppression such as that taught in U.S. Pat. No. 3,848,172, issued to R. E. Thomas; both of the aforementioned patents being assigned to the assignee of the instant application. Additionally, techniques have been developed for the derivation of angular rate signals that require non-similar redundant signals which are nonlinearly processed as taught in U.S. Pat. No. 3,568,960, issued to C. D. Griffith and cross-multiplication of sine and cosine signals derived from a Scott T transformer as taught in U.S. Pat. No. 3,514,719, issued to N. H. Rhodes. These prior art techniques are generally complex and costly, and a cheaper, simpler technique is desirable.

The present invention is directed to a simple method for deriving both angular error and angular rate signals, which does not require quadrant switching with its concomittant transient suppression, analog-to-digital conversion, or the use of a Scott T transformer for the generation of sine and cosine signals.

SUMMARY OF THE INVENTION

The present invention provides a means by which three-wire synchro data is processed with analog electronics to derive an angular rate signal representative of the angular rate of the synchro shaft and an angular error signal representative of the angular displacement of the synchro shaft from an established reference angle. Conventionally, a three-wire synchro control transmitter comprises an a.c. excited rotor winding usually 400 Hz and three 120° phase displaced stator windings (usually identified as the X, Y and Z legs, the rotor winding inducing into each of the stator windings a 400 Hz voltage, modulated in accordance with the angular position of the rotor winding relative thereto. For example, for a complete rotation of the rotor relative to the stator, the modulation envelope of the output of each stator winding will vary sinusoidally with a 120° phase displacement therebetween, the amplitude of the envelope being proportional to the rotor excitation voltage. If one of the windings, for example, the Z winding, is referenced to ground, sinusoidal voltage envelopes XZ and YZ may be derived. The above characteristics are embodied in the present invention to convert the three-wire control transmitter output data to two sinusoidal voltages $V_{XZ}$ and $V_{YZ}$. These voltages are then demodulated and each coupled to a feedback loop containing an integrator wherein lagged derivatives of the demodulated signals are generated, while at the same time following up to the input of the loop to provide a synchronized reference angle. Each output signal of the integrator loops is cross-multiplied with the input signal of the other loop in an analog multiplier, whereafter the output signals of the analog multipliers are summed to provide a continuous angular rate with a lag time constant established by the gain of the integrators. The sum signal is then coupled to a parallel combination of an amplifier, with an amplification essentially equal to the gain of loop integrators, and a differentiator to eliminate (or modify) the lag on the rate signal. When an angular rate about a given reference angle is desired, the loop is opened establishing a reference signal at the loop input, which in turn establishes a signal representative of the angular error as the summation output signal. The differentiation of this signal then establishes the angular rate about this reference angle.

BRIEF DESCRIPTION OF THE DRAWING

The single FIGURE shows a block diagram of a preferred embodiment of the instant invention.

DESCRIPTION OF THE PREFERRED EMBODIMENT

Referring now to the figure wherein is shown a block diagram of the synchronizer 10. Three-wire synchro data at terminals X, Y and Z provide voltages $V_{XZ}$ between terminals X and Z and $V_{YZ}$ between terminals Y and Z. These voltages are demodulated in demodulators 11 and 12 producing voltages $e_1$ and $e_2$ at the output terminals 13 and 14, which may be expressed as:

$$e_1 = A \sin(\omega t - 120°)$$
$$e_2 = A \sin(\omega t + 120°)$$

where A is an arbitrary scaling constant, $\omega t$ is the synchro angular position and $\omega$ is the synchro angular rate. A signal modifying circuit 15 which includes summation network 16, switch 17 and integrator 18 is coupled to terminal 13 at input terminal 16a of summation network 16. A second signal modifying circuit 21 which includes summation network 22, switch 23 and integrator 24 is coupled to terminal 14 at input terminal **22*a* of summation network 22. Thus signal voltage $e_1$ is coupled to signal modifying circuit 15 and signal voltage $e_2$ is coupled to signal modifying circuit 21. An output terminal 16*b* of summation network 16 is coupled to switch 17 at terminal 17*a* to multiplier 25 at a first input terminal 25*a*, a second input terminal 25*b* being coupled to the output terminal 14 of demodulator 12, while an output terminal 22*b* of summation network 22 is coupled to switch 23 at terminal 23*a* and to multiplier 27 at a first input terminal 27*a*, a second input terminal 27*b* being coupled to output terminal 13 of demodulator 11. A common terminal 17*c* of switch 17 is coupled to integrator 18 at input terminal 18*a*, the output terminal 18*b* of which is coupled to input terminal 16*c* of summation network 16. Similarly, a common terminal 23*c* of switch 23 is coupled to integrator 24 at input terminal 24*a*, output terminal 24*b* of which is coupled to input terminal 22*c*** of summation network 22. Terminals 17*b* and 23*b* of switches 17 and 23, respectively, are uncoupled.

When the system is in the sync mode, movable arm 17d of switch 17 is positioned to contact terminal 17*a* and the movable arm 23*d* of switch 23 is positioned to contact terminal 23*a*, forcing integrators 18 and 24 to track the voltages $e_1$ and $e_2$ respectively, and providing voltages $e_3$ and $e_4$ at terminals 25*a* and 27*a* respectively, which, with integrators 18 and 24 having time constants of 1/k, may be expressed as:

$$e_3 = \frac{\omega}{\sqrt{k^2+\omega^2}} \cos(\omega t - 120° - \phi) - \frac{ke^{-kt}}{\sqrt{k^2+\omega^2}} \sin(\phi + 120°) + \sin 120° \, e^{-kt}$$

$$e_4 = \frac{\omega}{\sqrt{k^2+\omega^2}} \cos(\omega t + 120° - \phi) - \frac{ke^{-kt}}{\sqrt{k^2+\omega^2}} \sin(\phi - 120°) - \sin 120° \, e^{-kt}$$

where: $\phi = \tan^{-1}\omega/k$

With the voltages $e_2$ and $e_3$ coupled to the input terminals 25*a* and 25*b* of multiplier 25, a voltage proportional to the product of $e_2$ and $e_3$ is coupled to an output terminal 25*c* of multiplier network 25 which in turn is coupled to summation network 30 at terminal 30*a*. Similarly, with the voltages $e_1$ and $e_4$ coupled to the input terminals 27*a* and 27*b* of multiplier network 27, a voltage proportional to the product of $e_1$ and $e_4$ is coupled to an output terminal 27c of multiplier 27 which in turn is coupled to the summation network 30 at terminal 30*b*. Signal voltage $e_5$ at an output terminal 30*c* of summation network 30 is the difference between the two signals at the input terminals 30*a* and 30*b*, this output signal being given by:

$$e_5 = \sin 240° \left[ \frac{k\omega}{k^2+\omega^2} - \left( \frac{k^2 \sin\omega t}{k^2+\omega^2} + \frac{k\omega}{k^2+\omega^2} \cos \omega t - \sin \omega t \right) e^{-kt} \right]$$

when $\omega$ is small with respect to $k$ the Laplace transform of $e_5$ is :

$$E_5(s) = \frac{\omega \sin 240°}{s(s+k)}$$

The signal voltage $e_5$ is coupled from the output terminal 30*c* of the summation network 30 to an input terminal 31a of an operational circuit 31 which includes summation network 32, differentiator 34, amplifier 35 and switch 36. Input terminals 34a and 35a of differentiator 34 and amplifier 35 respectively are coupled to terminal 31*a*, while output terminal 34*b* of differentiator 34 is coupled to input terminal 32a of summation network 32 and output terminal 35*b* of amplifier 35 is coupled to terminal 36*a* of switch 36. Terminal 36*b* of switch 36 is coupled to input terminal 32*b* of summation network 32 and terminal 36*c* of switch 36 is uncoupled. The signal $e_5$ coupled from terminal 31*a*, is differentiated in differentiator 34 and a signal proportional to the derivative with respect to time of $e_5$ is coupled from output 34*b* of differentiator 34 to the input terminal 32*a* of summation network 34. When the system is in the sync mode, movable arm 36*d* of switch 36 is in contact with terminal 36*b*, a signal which is the amplification of $e_5$ is coupled from output terminal 35*b* of amplifier 35 and a signal which is proportional to the sum of the signals at the output terminals 34*b* and 35*b* of differentiator 34 and amplifier 35 respectively, is coupled to output terminal 32*c* of summation network 32. When the amplifier 35 has a gain that is essentially equal to $k$, the inverse of the integrator time constant, the transfer function between terminals 3/*a* and 32*c* is equal to $s + k$ and the output signal $e_6$ at terminal 32*c* is proportional to the desired angular rate and may be expressed as:

$$e_6 = \omega \sin 240°$$

When the system is in the hold mode, the movable arms 17*d*, 23*d* and 36*d* are removed from terminals 17*a*, 23*a* and 36*a* and placed in contact with terminals 17*b*, 23*b* and 36*b* of switches 17, 23 and 36, respectively, decoupling the input terminals 18a and 24*a* of integrators 18 and 24 from the output terminals 16*b* and 22*b* of summation networks 16 and 22, respectively and decoupling output terminal 35*b* of amplifier 35 from input terminal 32*b* of summation network 32. At this time, integrated values of $e_3$ and $e_4$ are stored in integrators 18 and 24, respectively, and are coupled to the respective output terminals 18*b* and 24*b*. These signals, appearing at terminals 18*b* and 24*b* which define a stored reference angle $\psi_{REF}$, may be expressed as:

$$e_3 = \sin(\psi_{REF} - 120°) \quad e_4 = \sin(\psi_{REF} + 120°)$$

though, in this embodiment, signals defining the reference angles are derived from the stored integrated values of integrators 18 and 24, it should be understood that signals defining a reference angle may be coupled to input terminals 16*c* and 22*c* of summation networks 16 and 22, respectively, from external sources. After cross multiplying by multipliers 25 and 27 and summing in summer 30 as heretofore described, the signal $e_5$ at output terminal 30*c* of summer 30, which is coupled to input terminal 34*a* of differentiator 34, is then given by:

$$e_5 = -\sin 240° \sin(\omega t - \psi_{REF})$$

which for small angular variations about $\psi_{REF}$ is:

$$e_5 = -(\omega t - \psi_{REF}) \sin 240°$$

which is the desired angular error signal and is made available by coupling terminal 30*c* to terminal 37. Terminal 30*c* is also coupled to input terminal 34*a* of differentiator 34, wherein the signal $e_5$ is differentiated with respect to time to yield the desired angular rate $\omega$ and the resulting signal is coupled to output terminal 34*b* from which it is coupled to output terminal 32*c* of summation network 32.

The small angle approximation is a valid assumption in the description of the rate taker, since use of the synchronizer in the hold mode generally implies small variations about a reference angle. For example, in a heading hold autopilot, the angular difference $\psi_{REF}$ is typically less than 2°.

While the invention has been described in its preferred embodiment, it is to be understood that the words which have been used are words of description rather than limitation, and that changes may be made within the purview of the appended claims without departing from the true scope and spirit of the invention in its broader aspects.

What is claimed is:

1. An apparatus for extracting signals representative of an angular variable, $\omega t$, and the time rate of change, $\omega$, thereof from three phase synchro generated signals which are modulated by data signals defining said angular variable and said time rate of change comprising:

three terminal input means coupled to receive said three phase synchro generated signals for developing first and second signals modulated by data signals with modulation of the form sin $(\omega t + \theta)$ and sin $(\omega t - \theta)$;

first and second demodulator means coupled to receive said first and second data modulated signals respectively, for providing demodulated signals proportional to sin $(\omega t + \theta)$ and sin $(\omega t - \theta)$, first and second signal modifying means responsive to said demodulated signals from said first and second demodulator means respectively for providing an output signal which is representative of the derivative with respect to time of said demodulator signal including:

an integrator having an input means and an output means providing a signal at said output means that is representative of the integration with respect to time of a signal at said input means, combining means coupled to said demodulated signal of said demodulator as a first input signal and said output signal of said integrator as a second input signal for providing an output signal proportional to the difference between said first and second input signals, said output signal coupled to said input terminal of said integrator and providing said output signal of said signal modifying means;

first multiplier means coupled to receive said demodulated signal from said second demodulator as a first input signal and said output signal of said first signal modifying means as a second input signal for combining said first and second input signals and providing an output signal that is proportional to the product thereof;

second multiplier means coupled to receive said demodulator signal of said first demodulator as a first input signal and said output signal of said second signal modifying means as a second input signal for combining said first and second input signals and providing an output signal that is proportional to the product thereof;

summation means coupled to receive said output signal of said first multiplier as a first input signal and said output signal of said second multiplier as a second input signal for providing an output signal that is representative of the difference between said first and second input signals; and operational means responsive to said output signal of said summation means for performing mathematical operations on said output signal from said summation means whereby a signal proportional to the time rate of change of said variable is provided.

2. An apparatus for extracting signals representative of an angular variable and the time rate of change thereof in accordance with claim 1 wherein said operational means includes:

an amplifier coupled to receive said output signal of said summation means and providing an output signal proportional thereto;

differentiator means, coupled to receive said output signal of said summation means, for providing a signal that is proportional to the derivative with respect to time thereof; and algebraic summation means coupled to receive said output signal of said amplifier as a first input signal and said output signal of said differentiator means as a second input signal, for providing an output signal that is proportional to the sum of said first and second input signals.

3. An apparatus for extracting signals representative of an angular variable and the time rate of change thereof in accordance with claim 2 wherein:

said first and second signal modifying means further includes, a first switch means for switchably coupling said output signal of said combining means to said input means of said integrator, said output signal of said integrator providing a fixed reference signal, as said second input signal, to said combining means when said input means of said integrator is decoupled from said output signal of said combining means by said first switch means; and said operational means further includes, a second switch means for switchably coupling said output signal of said amplifier to said algebraic summation means, whereby said output signal of said algebraic summation means is proportional to the time rate of change of said variable when said output signal of said combining means is coupled to said integrator input means and said output signal of said amplifier is coupled to said algebraic summation means, while said output of said summation means is proportional to an error of said variable relative to said reference signal and said output signal of said algebraic summation means is proportional to the time rate of change of said variable when said output signal of said combining means is decoupled from said integrator input means and said output signal of said amplifier is decoupled from said algebraic summation means.

4. An apparatus for extracting signals representative of an angular variable and the time rate of change thereof in accordance with claim 1 wherein:

said first and second signal modifying means includes means for receiving first and second signals, that define a given reference and couple respectively to said combining means as said second input signal; and said operational means includes a differentiator means coupled to receive said output signal of said summation means for providing an output signal that is proportional to the time derivative of said output signal of said summation means, whereby said output signal of said summation means is proportional to the error between said given variable and said given reference and said output signal of said differentiator means is proportional to the time rate of change of said given variable.

* * * * *